US008277004B2

(12) United States Patent
Chung

(10) Patent No.: US 8,277,004 B2
(45) Date of Patent: Oct. 2, 2012

(54) REFRIGERATOR AND OPENING/CLOSING APPARATUS OF THE SAME

(75) Inventor: Sung Hoon Chung, Seoul (KR)

(73) Assignee: LG Electronics Inc., Seoul (KR)

( * ) Notice: Subject to any disclaimer, the term of this patent is extended or adjusted under 35 U.S.C. 154(b) by 683 days.

(21) Appl. No.: 11/206,872

(22) Filed: Aug. 19, 2005

(65) Prior Publication Data

US 2006/0043853 A1 Mar. 2, 2006

(30) Foreign Application Priority Data

Aug. 26, 2004 (KR) ..... 10-2004-0067498

(51) Int. Cl.
*A47B 96/04* (2006.01)
*A47B 95/02* (2006.01)

(52) U.S. Cl. ..... 312/405; 312/319.7

(58) Field of Classification Search ..... 312/405, 312/402, 319.5–319.8, 404, 334.27–334.43, 312/334.24
See application file for complete search history.

(56) References Cited

U.S. PATENT DOCUMENTS

| | | | | |
|---|---|---|---|---|
| 2,040,634 | A * | 5/1936 | Sekyra | 62/382 |
| 2,064,926 | A * | 12/1936 | Kuebler | 62/382 |
| 2,421,439 | A * | 6/1947 | Smith | 62/382 |
| 2,456,429 | A * | 12/1948 | Parsons | 91/533 |
| 2,497,734 | A * | 2/1950 | Kuklich | 312/312 |
| 2,506,448 | A | 5/1950 | Gregor | |
| 2,614,020 | A * | 10/1952 | Collins | 312/312 |
| 2,780,926 | A | 1/1955 | Sharpe | |
| 2,895,781 | A * | 7/1959 | Latter et. al. | 312/319.7 |
| 4,358,171 | A | 11/1982 | Christen | |
| 4,436,352 | A | 3/1984 | Okada et al. | |
| 4,984,854 | A * | 1/1991 | DeLavallade | 312/330.1 |
| 6,533,375 | B2 * | 3/2003 | Fulterer et al. | 312/319.8 |
| 6,925,836 | B2 | 8/2005 | Chung et al. | |
| 2003/0074911 | A1 | 4/2003 | Doran | |
| 2003/0122459 | A1 * | 7/2003 | Huber et al. | 312/319.6 |
| 2004/0232810 | A1 * | 11/2004 | Kreyenkamp | 312/322 |
| 2005/0120738 | A1 | 6/2005 | Chun et al. | |

FOREIGN PATENT DOCUMENTS

| | | |
|---|---|---|
| CN | 2279568 | 4/1998 |
| CN | 1465946 | 1/2004 |
| JP | 2-136686 | 5/1990 |
| JP | 4-11388 | 1/1992 |
| JP | 4-78493 | 3/1992 |
| JP | 05-296647 | * 11/1993 |
| JP | 2002-267352 | 9/2002 |

OTHER PUBLICATIONS

Translation of JP 05-296647 to Denpo by Schreiber Translations, Nov. 2006.*
Translation of JP 05-296647, Schreiber Translations, Nov. 2006.*
Translation of JP 2136686, The McElroy Translation Company, Mar. 2011.*
English Language Abstract of JP 2002-267352.
English Language Abstract of CN 1465946.
English language abstract of JP 4-78493.
English language abstract of JP 4-11388.
English language Abstract of JP 2-136686, May 25, 1990.

* cited by examiner (Continued)

*Primary Examiner* — Darnell Jayne
*Assistant Examiner* — Timothy M Ayres
(74) *Attorney, Agent, or Firm* — McKenna Long & Aldridge LLP

(57) ABSTRACT

A refrigerator includes an opening/closing apparatus. In the refrigerator and opening/closing apparatus, an extendible cabinet with shelves is accommodated in a storing compartment. Therefore, food or other items can be loaded in the cabinet and taken out from the cabinet more easily.

6 Claims, 10 Drawing Sheets

REFRIGERATOR AND OPENING/CLOSING APPARATUS OF THE SAME

This application claims the benefit of Korean Application No. 10-2004-67498 filed on Aug. 26, 2004, which is hereby incorporated by reference in its entirety for all purposes as if fully set forth herein.

BACKGROUND OF THE INVENTION

1. Field of the Invention

The present invention relates to a refrigerator, and more particularly, to an opening/closing apparatus for a refrigerator, which provides convenient freezing and chilling storage and a convenient take-out structure.

2. Description of the Related Art

A heat exchanging system in a refrigerator includes a compressor for compressing refrigerant, a condenser for condensing the compressed refrigerant, an expansion valve for expanding the condensed refrigerant, and an evaporator for evaporating the expanded refrigerant. The refrigerant as it evaporates at the evaporator takes heat from surrounding air, generating cooling air. This cooling air circulates through the inside of the refrigerator to cool food.

Structurally, the refrigerator includes an outer case, a machine compartment, and a food storing compartment. In the machine compartment, the compressor, condenser, expansion valve, and evaporator are disposed. The food storing compartment is provided with cooling air for storing food therein. Also, the refrigerator includes a door installed at a predetermined portion of the food storing compartment for opening and closing the food storing compartment.

The food storing compartment includes a plurality of shelves on which food is placed. The shelves may be capable of sliding. A recent side-by-side type refrigerator includes a chilling chamber and a freezing chamber that are located on left and right sides, providing convenience to the user.

Refrigerators of the related art, however, have a disadvantage in that a possibility of interference between the inside of the door and the shelves restricts the storage capacity of the refrigerator. Also, since the gap between the inside of the door and the shelves is not viewed, the user may overload food in the bin of the door. In this case, the door may not close and the user has to move the food to another place, causing inconvenience to the user.

Further, when the shelf is fully filled with food, inside food is hard to find. Even when the user knows which food is placed deep inside of the shelf, the user has to take out the front food to take out the inner food.

Further, since the opening and closing of the door is manually carried out, the old and the weak may have some difficulties in opening and closing the door. Also, when the door is opened, outside air is forced to flow into the refrigerator, dissipating the cooling air inside the refrigerator.

SUMMARY OF THE INVENTION

Accordingly, the present invention is directed to a refrigerator and opening/closing apparatus of the same that substantially obviates one or more problems due to limitations and disadvantages of the related art.

An object of the present invention is to provide a refrigerator and opening/closing apparatus of the same that can be used more conveniently.

Another object of the present invention is to provide a refrigerator and opening/closing apparatus of the same, in which food in a storing compartment can be more easily viewed to allow a user to quickly find and take out the food.

A further object of the present invention is to provide a refrigerator and opening/closing apparatus of the same, which provides a convenient storing compartment.

A still further object of the present invention is to provide a refrigerator and opening/closing apparatus of the same, which provides a convenient way of opening and closing the refrigerator for the old or the weak and also provides a power-saving structure.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims as well as the appended drawings.

To achieve these objects and other advantages and in accordance with the purpose of the invention, as embodied and broadly described herein, there is provided an opening/closing apparatus for a refrigerator, including: a case forming an outside of the refrigerator; a storing compartment defined inside of the case and kept at a low temperature; a cabinet slidably installed in the storing room for storing food or other items; and a cabinet front fixed to a front of the cabinet to close the storing room.

In another aspect of the present invention, there is provided an opening/closing apparatus for a refrigerator, including: an opening/closing switch turned on and/or off according to a user's manipulation to slide a cabinet accommodated in the refrigerator to open and/or close the cabinet; an opening sensor detecting the opening of the cabinet; a closing sensor detecting the closing of the cabinet; and a driving unit driving the cabinet in response to turning-on and/or turning-off the opening/closing switch.

In a further another aspect of the present invention, there is provided a refrigerator including: a case forming an outside of the refrigerator; at least one storing compartment defined inside of the case and kept at a low temperature; a cabinet slidably installed in the storing room; a cabinet front fixed to a front of the cabinet to selectively close the storing room; and a plurality of shelves into which food or other items are loaded when a side of the cabinet is opened.

In yet another aspect of the present invention, a refrigerator includes an outer case, and at least one cabinet slideably provided inside the outer case, the cabinet having an interior that is accessible from a side of the refrigerator. The refrigerator also includes a cabinet front attached to each cabinet, the cabinet front including a surface forming a portion of an exterior of the refrigerator and configured to enable access to the interior. Thus, a user can access items in the refrigerator from the side of the refrigerator by sliding the cabinet. The refrigerator may include an opening and closing system for opening the cabinet and closing the cabinet. The opening and closing system can be a motor for driving opening and closing of the cabinet. The opening and closing system may be provided at an upper first side of the cabinet, at an upper second side of the cabinet, at a lower first side of the cabinet, and at a lower second side of the cabinet. In one embodiment, the cabinet swivels when fully opened.

In still another aspect, a method for opening a refrigerator includes detecting a user manipulation, and driving, with a motor, a cabinet to slide out of the refrigerator, in response to detecting the user manipulation. The method also includes detecting that the cabinet is fully opened with a sensor, and stopping the driving when the sensor detects that cabinet is fully opened. The method may also include driving the cabinet in a reverse direction when the sensor has not detected that the cabinet is fully opened within a predetermined period of a time.

The present invention increases user's convenience and energy efficiency.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principles of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

First Embodiment

Figure 1:
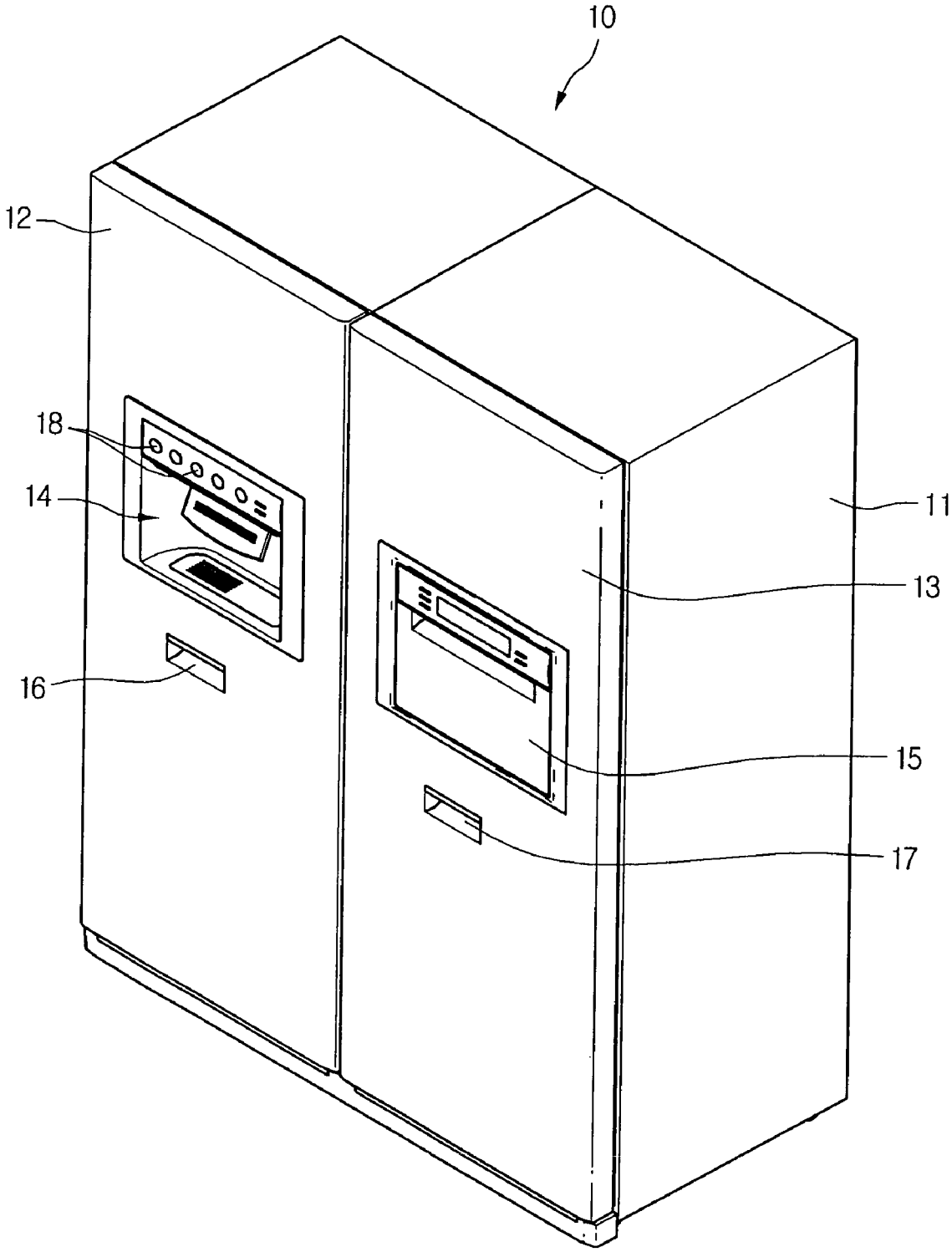
FIG. 1 is a perspective view of a refrigerator according to an aspect of the present invention.
Figure 2:
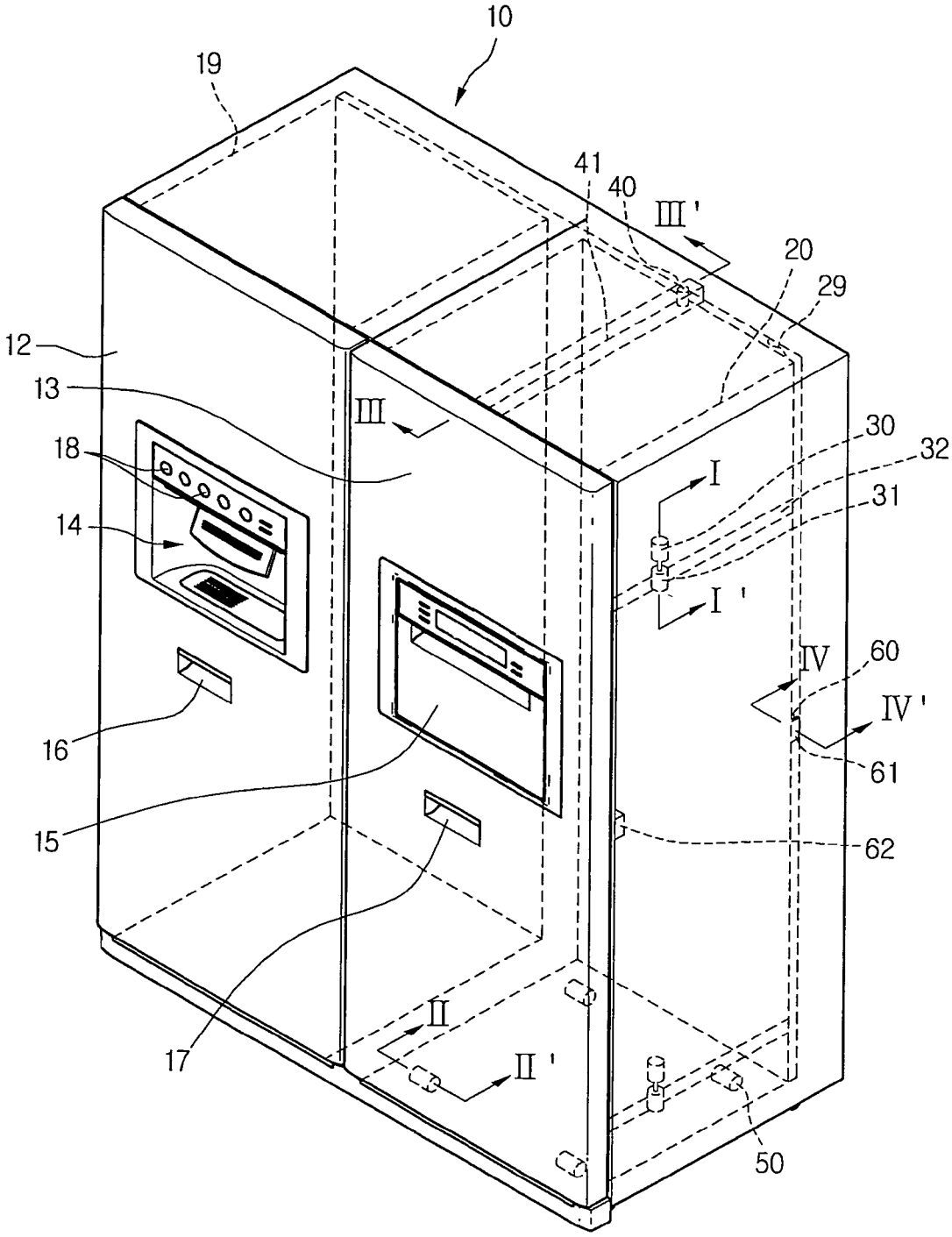
FIG. 2 is a phantom view of a refrigerator according to an aspect of the present invention.

FIG. 1 is a perspective view of a refrigerator according to an aspect of the present invention, and FIG. 2 is a phantom view of a refrigerator according to an aspect of the present invention.

Referring to FIGS. 1 and 2, a refrigerator 10 includes an outer case 11, cabinets 19 and 20, a first cabinet front 12, a second cabinet front 13, an ice dispenser 14, a home bar 15, a first handhold 16, and a second handhold 17. The outer case 11 forms the outside of the refrigerator 10. The cabinets 19 and 20 are slidably installed in the outer case 11 to store food. The term "food" is used here to refer to food or other substances to be stored in the refrigerator. The first and second cabinet fronts 12 and 13 are respectively fixed to the front of the cabinets 19 and 20. The ice dispenser 14 is formed at the first cabinet front 12, and the home bar 15 is formed at the second cabinet front 13. The first and second handholds 16 and 17 are respectively formed at center portions of the first and second cabinet fronts 12 and 13 to allow a user to slide out the cabinets 19 and 20. Also, the refrigerator 10 includes opening and closing buttons 18. A user can manipulate the opening and closing buttons 18 to extend and retract the cabinets 19 and 20 with a driving unit instead of manually extending and retracting the cabinets 19 and 20 with the handholds 16 and 17. A water dispenser may be formed instead of the home bar 15. Also, the home bar 15 and the ice dispenser 14 may not be included in the refrigerator 10.

Further, the refrigerator 10 includes a compressor, a condenser, an expansion valve, and an evaporator through which refrigerant is circulated for a refrigerating cycle. The compressor, condenser, and expansion valve may be disposed in a machine compartment that is located at a lower portion of the refrigerator 10.

The cabinets 19 and 20 may include a first cabinet 19 slidably installed at one side of the outer case 11 for serving as a freezing chamber and a second cabinet 20 slidably installed at the other side of the outer case 11 for serving as a chilling chamber. The arrangement or the number of the cabinets is not critical. For example, the cabinets may be arranged vertically or only one cabinet may be provided. Also, the cabinets may have other shapes and types. The handholds 16 and 17 may be formed at lateral center portions of the first and second cabinet fronts 12 and 13 to allow the user to extend the cabinets 19 and 20 easily.

Further, the refrigerator 10 includes an inner case (refer to 21 in FIG. 5) forming an inner wall of a food storing compartment 29 and an insulator 22 interposed between the inner case 21 and the outer case 11 for insulating the food storing compartment 29 from the outside. The food storing compartment 29, inside space of the inner case 21, is kept at a low temperature by circulating cool air therethrough. The cabinets 19 and 20 are accommodated in the food storing compartment 29. The cabinet fronts 12 and 13 are abutted against the cases 11 and 21 to close the food storing compartment 29. The cabinet front serves as a refrigerator door of the related art. A sealing member (not shown) may be interposed between the cabinet fronts and the cases to tightly close the food storing compartment 29.

The cabinets 19 and 20 are capable of extending from the refrigerator 10 owing to the above-mentioned structure, such that the user can load food from the side instead of loading the food from the front. In the cabinets 19 and 20, the depth (length) may be larger than the front width to allow the user to easily search the loaded food.

The opening and closing buttons 18, formed at one of the cabinet fronts 12 and 13 (shown is the first cabinet front 12), is used to open and close the respective cabinets 19 and 20. Alternatively, the opening and closing buttons 18 may be formed at both cabinet fronts 12 and 13. In this case, the user may easily distinguish buttons 18 for each cabinet.

Hereinafter, the sliding structure of the cabinets 19 and 20 will be more fully described. For the sliding motion, the refrigerator 10 may include a driving unit to drive the cabinets 19 and 20, a guide unit to guide the sliding motion of the cabinets 19 and 20, a supporting unit to supporting the weight of the cabinets 19 and 20, and a detecting unit to sense the movement of the cabinets 19 and 20 to detect opening and closing of the cabinets 19 and 20.

The driving unit is provided to automatically open and close the cabinets 19 and 20. If the opening and closing of the cabinets 19 and 20 are manually carried out using the handholds 16 and 17, the driving unit may not be required. Another way of opening and closing the cabinets 19 and 20, the opening/closing buttons 18 may be formed at the handholds 16 and 17, or the pulling action of the handholds 16 and 17 may be associated with the switch-on operation of the opening/closing buttons 18, such that the cabinets 19 and 20 can be automatically opened and closed by the driving unit.

Hereinafter, structure of each element of the refrigerator will be more fully described.

Figure 4:
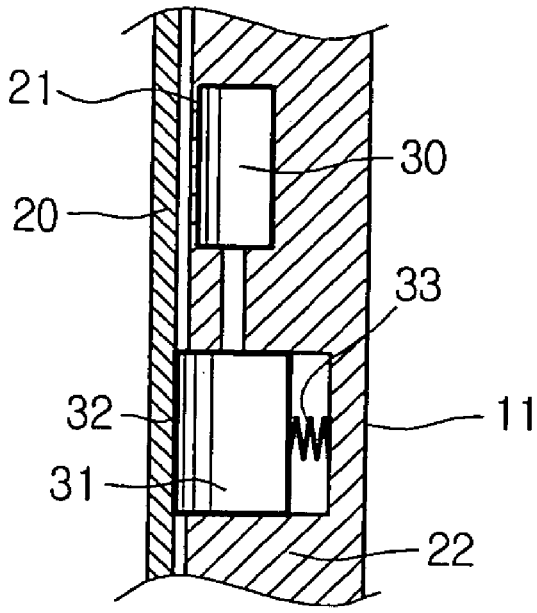
FIG. 4 is a section taken on line I-I' in FIG. 2.

First, the driving unit will be described with reference to FIG. 4, in which a section taken on line I-I' in FIG. 2 is shown. Referring to FIGS. 2 and 4, the driving unit includes a driving motor 30 disposed between the inner case 21 and outer case 11, an upper roller 31 coupled with a shaft of the driving motor 30, a friction portion 32 formed on the second cabinet 20 to make frictional contact with the upper roller 31 for smooth movement of the second cabinet 20, and a roller supporting part 33 to urge the upper roller 31 toward the friction portion 32 for preventing slippage. The structure and shape of the roller supporting part 33 is not limited to the illustrated one. Any structure and shape may be applied to the roller supporting part 33, so long as the upper roller 31 can be supported.

For smooth supporting of the roller supporting part 33, the upper roller 31, entirely or at least at the periphery, may be made of rubber material. Also, the rubber material of the upper roller 31 may smoothly support the upper roller 31 even when the roller supporting part 33 is not provided. The driving unit may be formed at four locations, upper and lower portions of each side of the cabinet, to securely support the sliding motion of the cabinet 20. Though the driving unit is described in association with the second cabinet 20, it will be applied to the first cabinet 19 in the same way.

In operation of the driving unit, the driving motor 30 rotates the upper roller 31. The rotation of the upper roller 31 is transmitted to the cabinet 20 through the contact surface between the upper roller 31 and the friction portion 32, such that the cabinet 20 can be moved in a forward direction. To balance the sliding motion of the cabinet 20, the same or similar structure is also provided at a lower side of the cabinet 20. Merely, the number and size of the roller can be changed depending on the size of the cabinet or for other reasons.

To select desired friction between the upper roller 31 and the friction portion 32, the material of the friction portion 32 and the spring constant of the roller supporting part 33 may be adjusted. Low friction may lead to slippage between the upper roller 31 and the friction portion 32, causing the cabinet to be suspended. On the contrary, high friction may cause overload to the driving motor 30. For example, when the cabinet 20 is not moved owing to an obstacle, the driving motor 30 can be damaged because the high friction prevents idle rotation (slippage) of the motor 30. Particularly, when a user's hand is shut in the cabinet, high friction may cause an accident. Therefore, the friction may be set to a predetermined level to allow slippage between the upper roller 31 and the friction portion 32 when there is an obstacle against the movement of the cabinet, thereby preventing accidents and damage to the driving motor 30.

Figure 5:
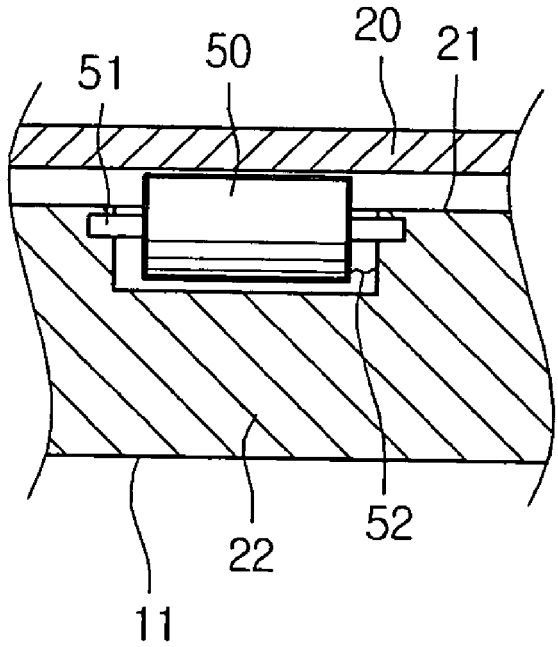
FIG. 5 is a section taken on line II-II' in FIG. 2.

Next, the supporting unit will be described with reference to FIG. 5, in which a section taken on line II-II' in FIG. 2 is shown. Referring to FIGS. 2 and 5, the supporting unit includes a supporting roller 50 abutted on a bottom of the second cabinet 20 to support the weight of the second cabinet 20, protrusions 51 extended from both sides of the supporting roller 50, and a receiving groove 52 defined in the inner case 21 to receive the supporting roller 50. The structure associated with the supporting roller 50 may be varied. For example, a predetermined structure may protrude from the inner case 21 to support the supporting roller 50, or a ball bearing may be provided to support the supporting roller 50.

The supporting roller 50 supports the bottom of the second cabinet 20, such that the second cabinet 20 can smoothly slide in the forward and backward directions.

Figure 6:
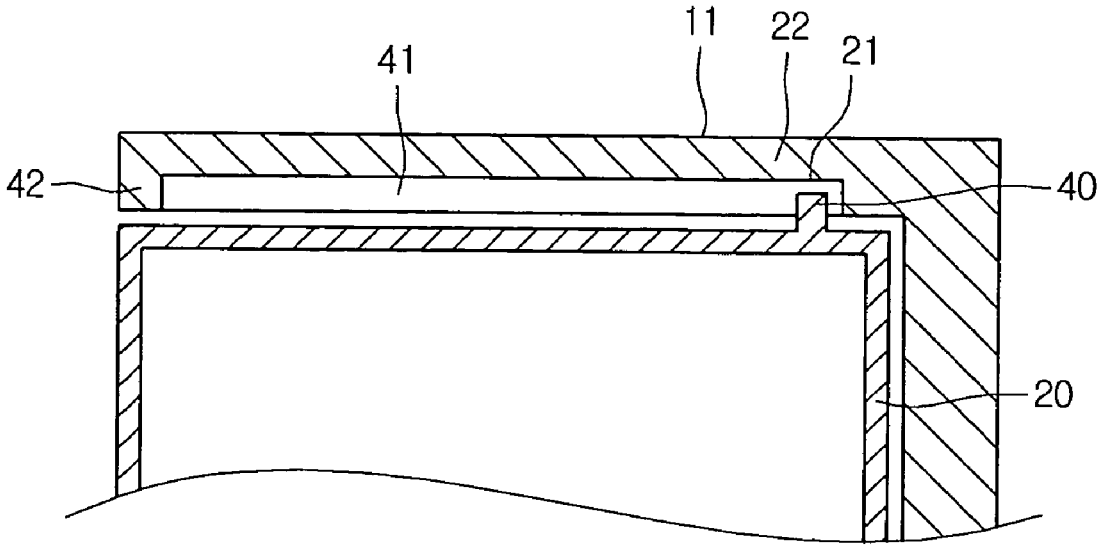
FIG. 6 is a section taken on line III-III' in FIG. 2.

Next, the guide unit will be described with reference to FIG. 6, in which a section taken on line III-III' in FIG. 2 is shown. Referring to FIGS. 2 and 6, the guide unit includes an upper guide protrusion 40 projecting from a top of the second cabinet 20, an upper guide groove 41 defined in the inner case 21 in a forward-to-backward direction to guide forward and backward movements of the upper guide protrusion 40, and a stop barrier 42 formed at a front end of the upper guide groove 41 to constrain the movement of the upper guide protrusion 40 within a predefined limit.

The upper guide protrusion 40 enables the second cabinet 20 to slide along a predefined path without joggle. The guide protrusion 40 and groove 41 may be formed at a top and a bottom of the cabinet. Also, the guide protrusion 40 and groove 41 may be formed at a side (sides) of the second cabinet 20, so long as the sliding motion of the second cabinet 20 can be securely guided. That is, the location and number of the guide protrusion 40 and groove 41 can be changed without departing from the spirit and scope of the present invention. The guide protrusion 40 and groove 41 may be formed along a centerline of the second cabinet 20 to allow swiveling motion of the extended second cabinet 20. When the second cabinet 20 is extended (opened), it can swivel in left and right directions within a predetermined angle. In other words, when the second cabinet is fully extended, the guide protrusion 40 serves as a hinge for the swiveling motion of the second cabinet 20.

Figure 7:
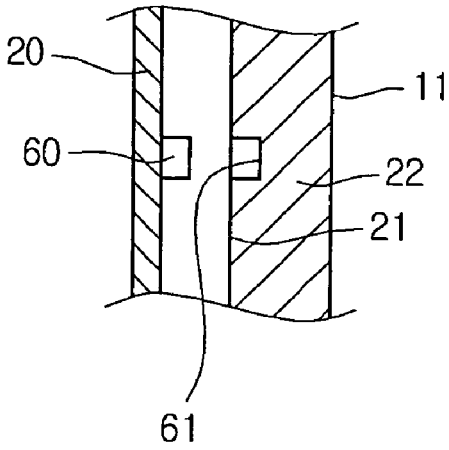
FIG. 7 is a section taken on line IV-IV' in FIG. 2.

Next, the detecting unit will be described with reference to FIG. 7, in which a section taken on line IV-IV' in FIG. 2 is shown. Referring to FIGS. 2 and 7, the detecting unit includes a first sensor 60 formed at a predetermined location of the second cabinet 20, a third sensor 61 formed at a corresponding location of the inner case 21, and a second sensor 62 formed at a predetermined location of the inner case 21. When the second cabinet 21 is fully extended, the first and second sensors 60 and 62 face with each other. That is, the first sensor 60 faces the third sensor 61 when the second cabinet 20 is retracted (closed), and it faces the second sensor 62 when the second cabinet 20 is extended (opened). The third sensor 61 and the second sensor 62 are connected with a controller of the refrigerator 10 through a cable or a wireless communication unit to detect the movement of the first sensor 60.

When the first sensor 60 is placed at a predetermined position (extended or retracted position), a corresponding detecting signal is generated and transmitted to the controller. Also, when the first sensor 60 is not placed at the predetermined position, a corresponding signal is generated and transmitted to the controller. The detecting unit may use, but is not limited to, magnetic sensors. In other words, the detecting unit includes an opening sensor portion to detect the opening of the cabinet and a closing sensor portion to detect the closing of the cabinet. The opening sensor includes the first sensor 60 and the second sensor 62 that are associated with each other to detect the opening of the cabinet, and the closing sensor portion includes the first sensor 60 and the third sensor 61 that are associated with each other to detect the closing of the cabinet. So long as the detecting unit can detect the opening and closing of the cabinet, various types of sensors can be used for the detecting unit.

Second Embodiment

According to a second embodiment of the present invention, the cabinet is capable of swiveling for easy access after it is extended (opened).

Figure 3:
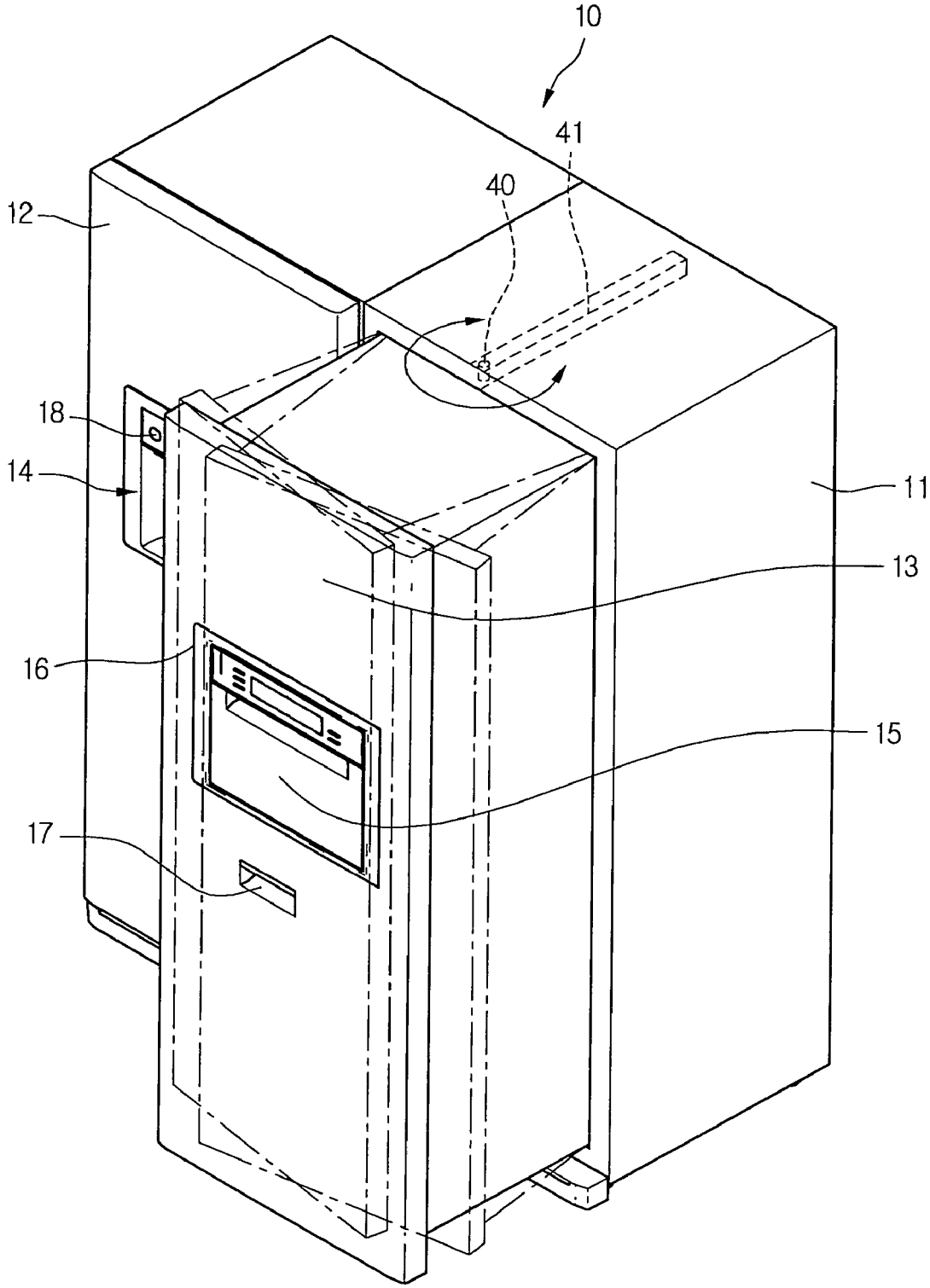
FIG. 3 is a perspective view of a refrigerator opened by an opening/closing apparatus according to an aspect of the present invention.

FIG. 3 is a perspective view of a refrigerator that is opened by an opening/closing apparatus according to an aspect of the present invention.

Referring to FIG. 3, an opening/closing apparatus of a refrigerator is designed such that a cabinet containing food is capable of sliding in forward and backward directions for easy access to the cabinet. Further, the extended cabinet is capable of swiveling in left and right directions within a predetermined angle, increasing accessibility to the cabinet. For the swiveling motion, the upper guide protrusion 40 serves as a hinge when the cabinet is extended. After the user extends the cabinet, the user can push the cabinet to swivel it to access the inside of the cabinet more easily.

The swiveling angle range of the cabinet is determined by the interference between the cabinet and the refrigerator body. In other words, the location of the upper guide protrusion 40 may determine the swiveling angle range of the cabinet. The swiveling structure of the cabinet is not limited to the illustrated one. For example, an additional hinge may be provided between the guide protrusion 40 and the cabinet to facilitate the swiveling motion of the cabinet. As another example, the inner case 21 may be formed with a hinge to be coupled with the guide protrusion 40 just before the cabinet is fully extended, such that the swiveling motion of the cabinet can be smoothly carried out.

Third Embodiment

According to this embodiment, an inner structure of the cabinet is designed for easy use by a user.

Figure 8:
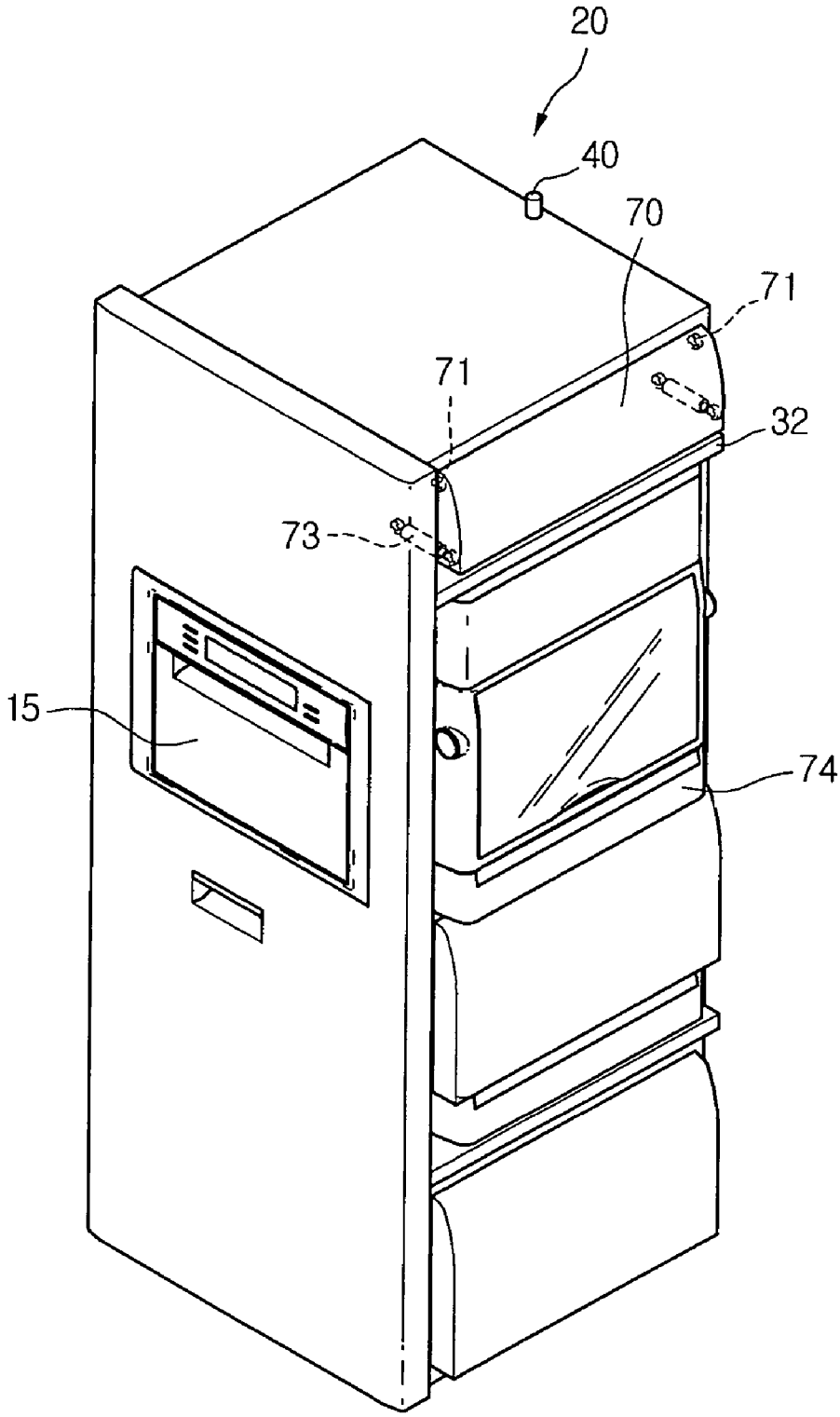
FIG. 8 is a perspective view of a cabinet according to an aspect of the present invention.

FIG. 8 is a perspective view of a cabinet according to an aspect of the present invention.

Referring to FIG. 8, a cabinet 20 has an elongated box shape. The cabinet 20 includes a guide protrusion 40 at a top and a plurality of extendable shelves 74 for containing food.

Each of the shelves 74 includes a cover (refer to 70 in FIG. 9) to protect inside food. Also the cover 70 prevents interference between the food of the shelves 74 and the inner case 21 when the cabinet 20 is extended or retracted. That is, when the cover 70 is not closed a user should rearrange the food in the shelves 74 to prevent interference between the food and the inner case 21. Further, the cover 70 prevents the cooling air inside the shelves 74 from dissipating outside when the cabinet 20 is extended (opened). The cover 70 may be made of transparent plastic to provide good see-through visibility.

The cover 70 is coupled to the cabinet 20 using transversely spaced hinge shafts 71. The cover 70 is rotatable in up and down directions. Gas springs 73 are provided to facilitate the opening and closing of the cover 70. The cover 70 can be opened by applying less force owing to the gas springs 73. Also, the cover 70 can be securely and completely closed owing to the gas springs 73. If the gas springs 73 are not provided, the user has to hold the opened cover 70 to prevent the cover 70 from rolling down, causing inconvenience.

A gas spring, having the same or substantially the same structure as the gas springs 73, is used for cars and trucks. Detailed description of the gas spring will be omitted because it is well known. A small gas spring, compared with the gas spring of the car or truck, may be used for the present invention.

Also, the cabinet 20 includes elongated friction portions 32 at side portions for frictional contact with the rollers 31. Tape having a predetermined frictional coefficient may be used to formed the friction portions 32, or the cabinet 20 may be formed with uneven surfaces to form the friction portions 32.

Figure 9:
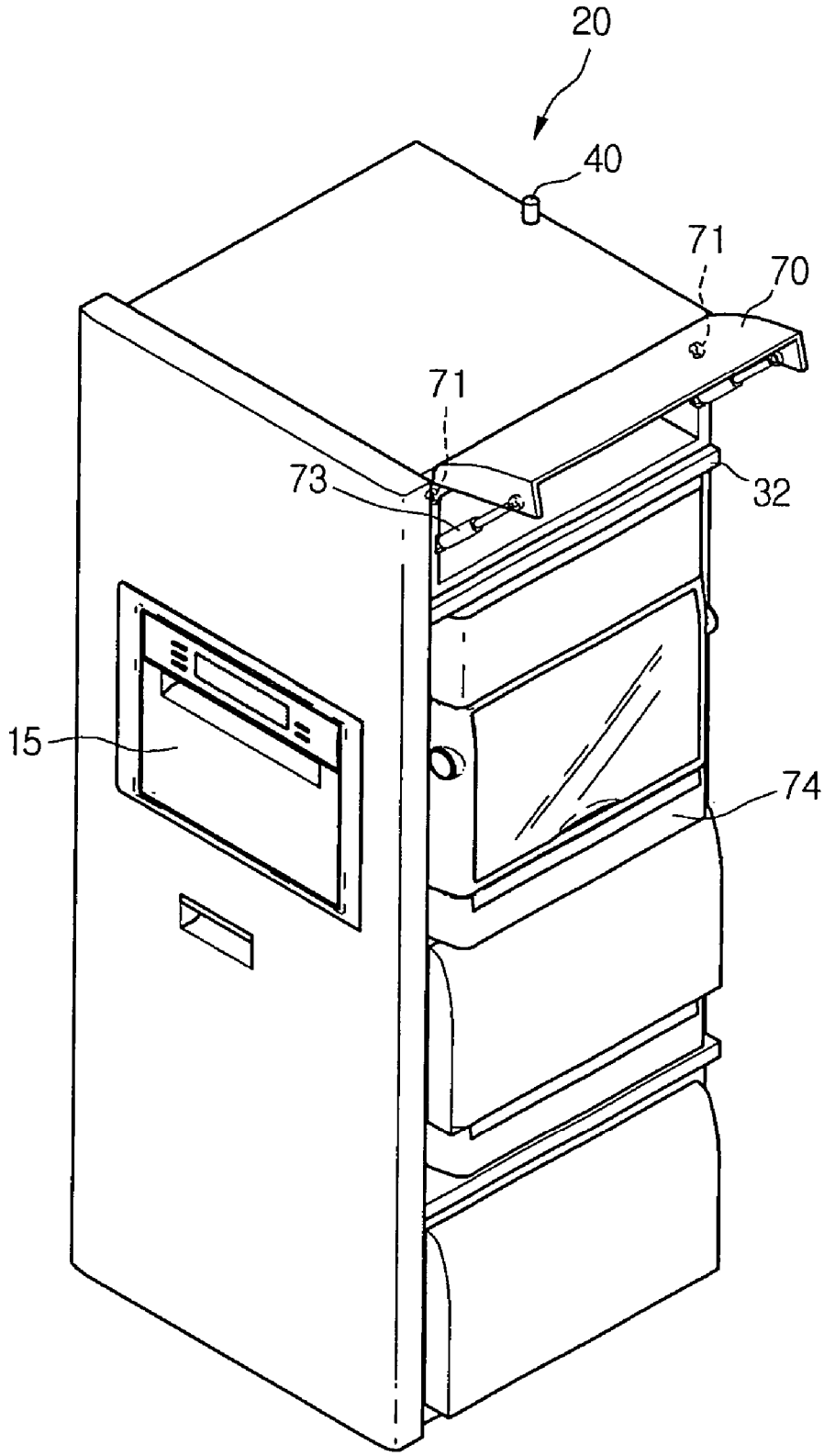
FIG. 9 is a perspective view of a cabinet in which a gas spring is extended according to an aspect of the present invention.

FIG. 9 shows the gas springs 73 when they are extended. Though the gas springs 73 are shown at one of the covers 70, other covers 70 may be provided with the gas springs 73 for the convenience of the user.

Fourth Embodiment

Figure 10:
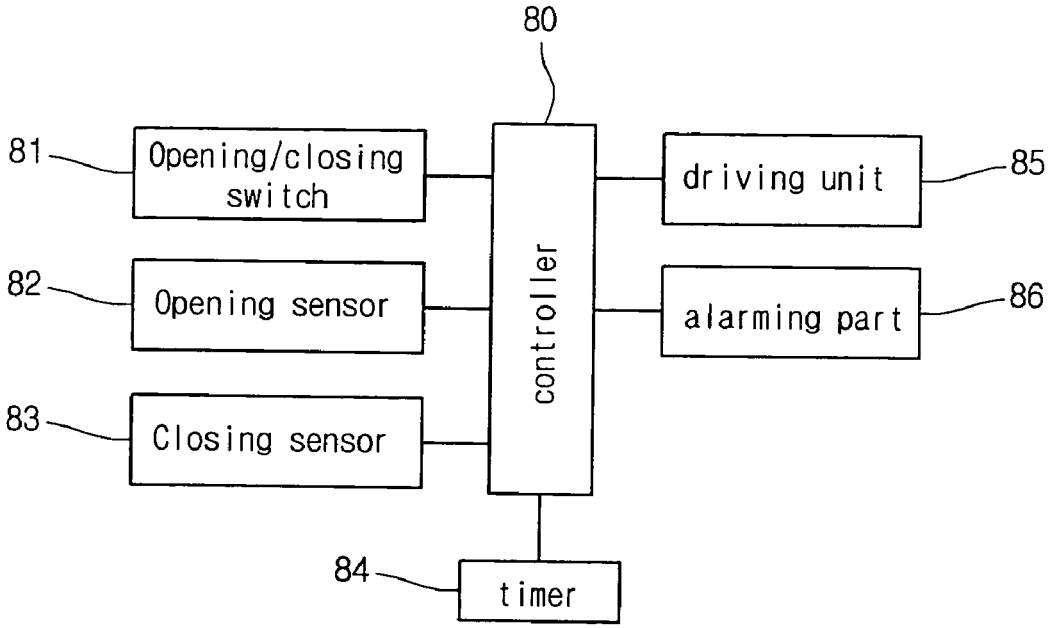
FIG. 10 shows a control block of an opening/closing apparatus of a refrigerator according to an aspect of the present invention.

FIG. 10 shows a control block of an opening/closing apparatus of a refrigerator according to an aspect of the present invention.

Referring to FIG. 10, a control block of an opening/closing apparatus includes an opening/closing switch 81, an opening sensor 82, a closing sensor 83, a driving unit 85, and an alarming part 86. The opening/closing switch 81 such as the opening/closing buttons 18 is provided to open the cabinet. The opening sensor 82 such as the first and third sensors 60 and 61 is provided to detect the opening of the cabinet. The closing sensor 83, such as the first and the second sensors 60 and 62, is provided to detect the closing of the cabinet. The driving unit 85 such as the driving motor 30 is provided to drive the cabinet to open/close the cabinet according to user's manipulation. The alarming part 86 generates an alarm signal when the cabinet is not opened or closed according to the user's manipulation.

Also, the control block includes a timer 84 and a controller 80. The timer 84 measures the operational time of the driving unit 85 and makes a notice when the operation of the driving unit 85 is not terminated within a predetermined time. The controller 80 receives signals from each element and outputs control signals for overall control of the opening/closing apparatus.

An operation of the opening/closing apparatus for a refrigerator will now be described.

When a user tries to open the cabinet, the opening/closing switch 81 detects the user's manipulation. In detail, the opening/closing switch 81 may be turned on when the user presses opening and closing buttons 18, or it may be turned on when the third sensor 61 detects the position variation between the first sensor 60 and the third sensor 61 upon the pulling of the handhold 16 or 17.

When the controller 80 detects the turn-on of the opening/closing switch 81, the driving unit 85 drives the cabinet to slide it out of the refrigerator 10. The guide groove 41 and guide protrusion 40 guide the sliding motion of the cabinet 20. When the cabinet is fully extended from the refrigerator 10 after a predetermined time, the opening sensor 82 detects the fully extended state of the cabinet and the controller 80 turns off the driving unit 85.

If the fully extended state of the cabinet is not detected by the opening sensor 82 after a predetermined time from the starting of the driving unit 85, it is assumed that an obstacle blocks the sliding motion of cabinet. In this case, the driving unit 85 may be driven in a reverse direction, the alarming part 86 may produce an alarm signal for the user, or the driving unit 85 may run idle owing to the slippage between the roller 31 and the friction portion 32 to prevent overheating of the motor. For the same reason, the driving unit 85 may run idle when the cabinet is not completely retracted (closed) due to an obstacle. Therefore, the friction coefficient between the roller 31 and the friction portion 32 may be determined to be below a specific level. Since the static and dynamic friction coefficients are different, the friction portion 32 can be formed to have different friction coefficients. For example, each end of the frictional portion 32 where the rotation of the roller 31 starts may have a higher friction coefficient, and the center may have a lower friction coefficient.

When the user tries to retract (close) the cabinet, the opening/closing switch 81 detects the user's closing manipulation. For example, the opening/closing switch 81 may detect the closing manipulation when the user presses opening and closing buttons 18 or when the relative position between the first and second sensors 60 and 62 is changed upon the pulling of the handhold 16 or 17.

When the closing instruction is transmitted to the controller 80, the driving unit 85 drives the cabinet to slide it toward the refrigerator 10. When the cabinet is fully retracted into the refrigerator 10 after a predetermined time, the closing sensor 83 detects the fully retracted position of the cabinet and the driving unit 85 is turned off. If the fully retracted position of the cabinet is not detected by the closing sensor 83 after a predetermined time measured by the timer 84, it is assumed that an obstacle blocks the sliding motion of cabinet. In this case, the driving unit 85 may be driven in the reverse direction, the alarming part 86 may produce an alarm signal for the user, or the driving unit 85 may run idle owing to the slippage between the roller 31 and the friction portion 32.

Owing to the idle running of the driving unit 85, the user can be protected when the user's finger or other body part is inserted between the cabinet and the refrigerator body. That is, the roller 31 may easily slip on the friction portion 32 when the sliding motion of the cabinet is hindered to protect the user, increasing product safety.

If the control components are not provided for the opening and closing of the cabinet, the user can manually open and close the cabinet by pulling and pushing the handholds 16 and 17.

Fifth Embodiment

In this embodiment, an opening structure of the cabinet will be exemplarily described.

Figure 11:
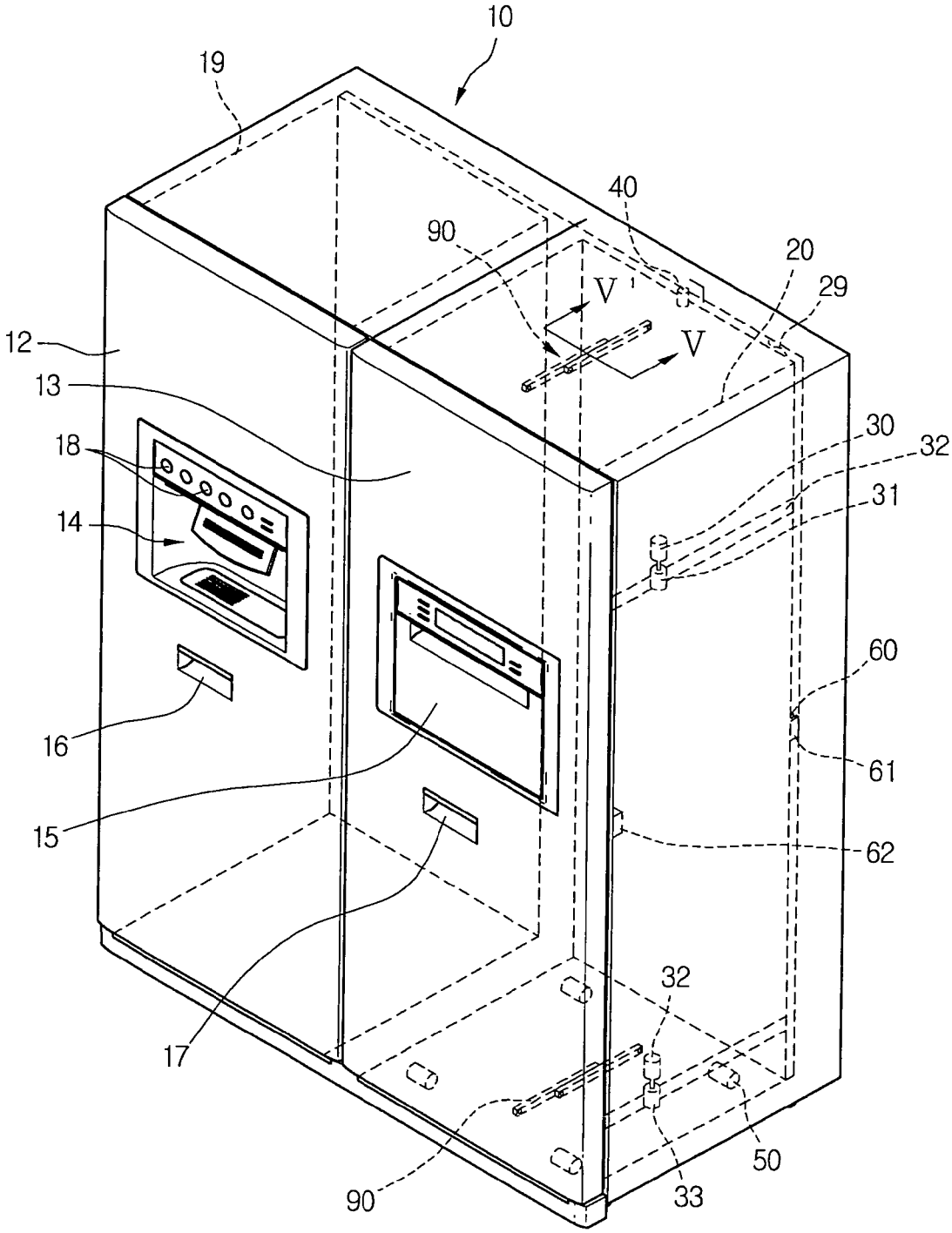
FIG. 11 is a phantom view of a refrigerator according to another embodiment of the present invention.
Figure 12:
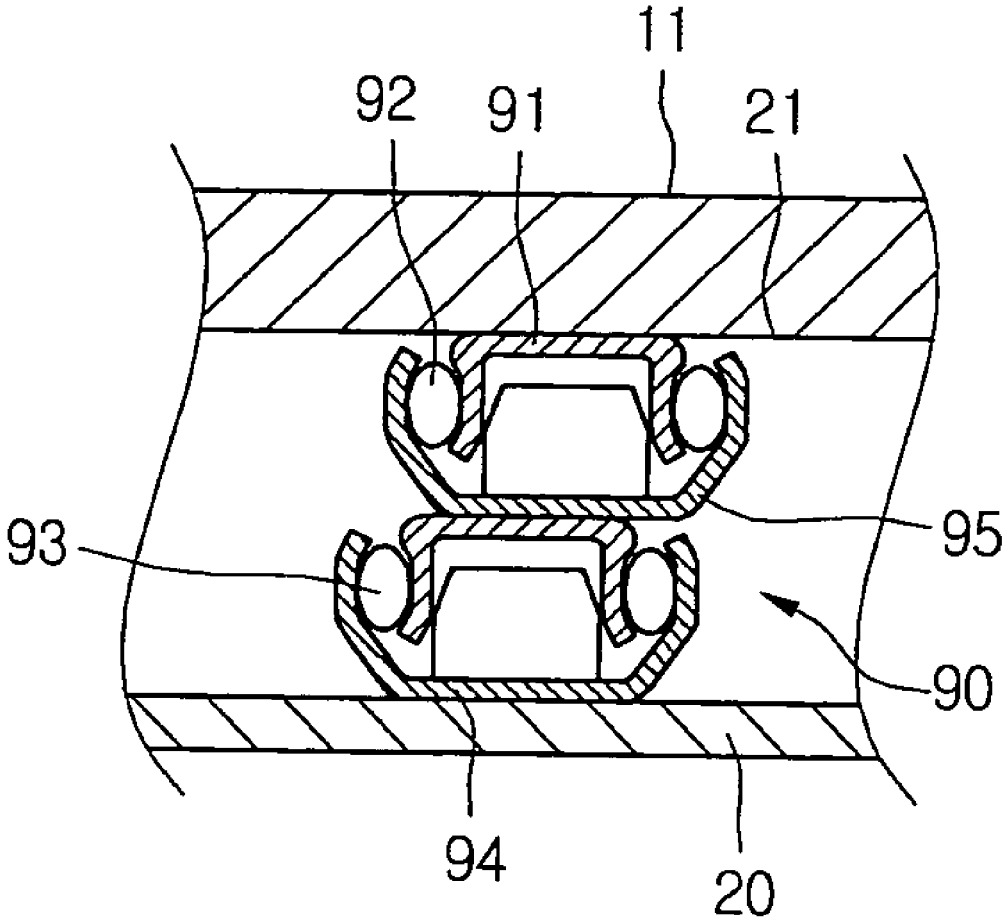
FIG. 12 is a section taken on line V-V' in FIG. 11.

FIG. 11 is a phantom view of a refrigerator according to a fifth embodiment of the present invention, and FIG. 12 is a section taken on line V-V' in FIG. 11.

Referring to FIGS. 11 and 12, a cabinet 20 includes telescopic members 90 at a top and a bottom. The telescopic members 90 guide sliding motion of the cabinet 20 in forward and backward directions. The telescopic member 90 includes one side fixed to the cabinet 20 and the other side fixed to the inner case 21 to exactly guide the sliding motion of the cabinet 20.

The telescopic member 90 includes a first fixed member 91 fixed to the inner case 21, a second fixed member 94 fixed to the cabinet 20, and a connecting member 95 disposed between the first and second fixed member 91 and 94. Also, the telescopic member 90 includes a first bearing 92 and a second bearing 93.

When the cabinet 20 is moved by a driving unit, the connecting member 95 and the second fixed member 94 are also moved under the guide of the bearings 92 and 93, such that the movement of the cabinet 20 is guided.

According to the present invention, the user can load food in the cabinet and take out food from the cabinet more easily. Particularly, when taking out the food the user can easily see all the food in the cabinet because the cabinet is wholly extendable to provide a good see-through view from the side.

Further, the opening and closing of the cabinet can be automated, such that the old and the disabled can easily use the refrigerator. Also, the cooling air dissipation, occurring when the door of the related art refrigerator is opened, can be prevented according to the present invention.

It will be apparent to those skilled in the art that various modifications and variations can be made in the present invention. Thus, it is intended that the present invention covers the modifications and variations of this invention provided they come within the scope of the appended claims and their equivalents.

The present disclosure relates to subject matter contained in Korean Application No. 10-2004-67498, filed on Aug. 26, 2004, the contents of which are herein expressly incorporated by reference in its entirety.

What is claimed is:

1. An opening/closing apparatus for a refrigerator, comprising:

a case forming an outside of the refrigerator;

a storing compartment defined inside of the case and kept at a low temperature;

a cabinet slidably installed in the storing compartment for storing items;

a cabinet front fixed to a front of the cabinet to close the storing compartment;

a detecting unit having a first sensor provided at the sliding cabinet and a second sensor provided at an inner case of the refrigerator, the first and second sensors configured to detect an initiation of one of an inward movement that closes the cabinet and an outward movement of the cabinet that opens the cabinet with respect to the case;

an opening/closing switch configured to change state from a first to a second state or from the second state to the first state to indicate a desired direction of a sliding movement of the cabinet;

a driving unit configured to control sliding movement of the cabinet toward the opened or closed positions with respect to the case, wherein the driving unit includes a driving motor, a roller coupled with a shaft of the driving motor, a friction portion formed on the cabinet to make frictional contact with the roller for smooth movement of the cabinet, and a roller supporting part to urge the roller toward the friction portion to prevent slippage;

a timer configured to measure an operational time of the driving unit corresponding to a time needed to slide the cabinet toward the opened or closed positions;

a controller in communication with the detecting unit, opening/closing switch, driving unit, and timer:

wherein, in response to the change of state of the opening/closing switch, the controller signals the driving unit to slide the cabinet to the opened or closed positions, wherein, when the controller detects the turn-on of the opening/closing switch, the driving unit drives the cabinet to slide it out of the refrigerator, and when the cabinet is fully extended from the refrigerator after a predetermined time, the opening sensor detects the fully extended state of the cabinet, the controller turns off the driving unit, wherein the controller receives the operational time of the driving unit from the timer after the controller signals the driving unit to slide the cabinet to the opened position and signals the driving unit to slide the cabinet to the closed position when the operational time of the driving unit exceeds a predetermined amount of time before the detecting unit detects the opened position of the cabinet, and then the driving unit may be driven to slide the cabinet to the closed position or may run idle owing to the slippage between the roller and the friction portion;

wherein when a closing instruction is transmitted to the controller, the driving unit drives the cabinet to slide it toward the refrigerator, and when the cabinet is fully retracted into the refrigerator after a predetermined time, the closing sensor detects the fully closed position of the cabinet, the driving unit is turned off;

wherein the controller receives the operational time of the driving unit from the timer after the controller signals the driving unit to slide the cabinet to the closed position and signals the driving unit to slide the cabinet to the opened position when the operational time of the driving unit exceeds a predetermined amount of time before the detecting unit detects the closed position of the cabinet, and then the driving unit may be driven to slide the cabinet to the opened position or may run idle owing to the slippage between the roller and the friction portion;

a guide unit to guide the sliding movement motion of the cabinet such that when the cabinet is in an opened extended position, the cabinet can swivel in left and right directions; and a supporting unit configured to support a weight of the cabinet, wherein the supporting unit is provided at a bottom of the case and contacts a lower surface of the cabinet, wherein each end of the frictional portion where the rotation of the roller starts may have higher friction coefficient, and center may have lower friction coefficient.

2. The opening/closing apparatus according to claim 1, wherein the supporting unit is rotatably coupled to the case.

3. The opening/closing apparatus according to claim 1, further comprising a hinge portion allowing the cabinet to swivel with respect to the case when the cabinet is extended from the storing compartment.

4. The opening/closing apparatus according to claim 1, wherein the guide unit comprises:

a protrusion projected from a top and/or a bottom of the cabinet; and an elongated guide groove defined in the case in a front-to-back direction to guide the protrusion.

5. The opening/closing apparatus according to claim 1, wherein the cabinet includes:

a shelf formed in the cabinet to accommodate the stored items;

a cover rotatable in up and down directions to protect the shelf; and a spring connected between the cover and the cabinet to guide rotation of the cover.

6. The opening/closing apparatus according to claim 1, wherein the cabinet front includes a handhold at a lateral center.

* * * * *